US005241297A

United States Patent [19]

Goodman

[11] Patent Number: 5,241,297

[45] Date of Patent: Aug. 31, 1993

[54] ALARM DEVICE

[76] Inventor: Gregory L. Goodman, 303 E. 37th St., Apt. 6B, New York, N.Y.

[21] Appl. No.: 888,783

[22] Filed: May 27, 1992

[51] Int. Cl.[5] ..... G08B 13/14

[52] U.S. Cl. ..... 340/568; 200/61.52; 200/287; 200/341; 340/666

[58] Field of Search ..... 340/568, 666; 200/61.52, 287, 341

[56] References Cited

U.S. PATENT DOCUMENTS

| | | | |
|---|---|---|---|
| 3,192,517 | 6/1965 | Werlin | 340/568 |
| 3,636,547 | 1/1972 | Brace et al. | 340/280 |
| 3,893,095 | 7/1975 | DeJong | 340/289 |
| 4,253,084 | 2/1981 | Topputo | 340/568 |
| 4,274,088 | 6/1981 | Pierson et al. | 340/568 |
| 4,795,863 | 1/1989 | Tomizu et al. | 200/16 B |
| 4,940,864 | 7/1990 | Aurand et al. | 200/342 |
| 4,996,400 | 2/1991 | Ricci et al. | 200/345 |
| 5,168,982 | 12/1992 | Hakanen et al. | 200/341 |

*Primary Examiner*—Glen R. Swann, III

*Attorney, Agent, or Firm*—Wigman, Cohen, Leitner & Myers

[57] ABSTRACT

Movement or removal of a display object placed on a base is detected by a switch mechanism for closing an electrical circuit, having an elongated plunger and a device for maintaining the throw length of the switch mechanism substantially constant and independent of the distance the plunger is depressed upon setting of the alarm. Detection of extremely short plunger travel is enabled without special adjustments in the plunger length. A "tilt" switch may be added for added sensitivity. A plurality of bases, each with its own switch, may be grouped with a single signalling device to provide an alarm system. Portions of the circuitry may be grouped in modular form for introduction into the base housing.

17 Claims, 3 Drawing Sheets

ALARM DEVICE

FIELD OF THE INVENTION

The present invention relates to an alarm device for signalling the occurrence of an incident. More particularly, the present invention is directed to anti-theft trigger switches and alarm devices for indicating the unauthorized removal of various objects, such as art objects, jewelry, or the like displayed on a decorative base housing or display riser. An alarm circuit and a trigger switch mounted in a decorative display riser base or housing detect and signal an alarm condition upon removal of the displayed object.

BACKGROUND OF THE INVENTION

Alarm switches and systems are known which permit signalling the theft or removal of an object from its place of rest or display. Examples include U.S. Pat. Nos. 4,274,088 to Pierson et al, 3,893,095 to DeJong et al, and 3,636,547 to Brace et al.

Conventionally, plunging trigger based alarm systems have incorporated a fixed switch contact and a movable switch contact, the throw length of which has been related to the length of the plunger movement required to set the alarm switch to the armed state. For concave underside display objects, as compared with a flat or shallow concave underside display object, a longer plunger length has been used to accommodate the extent of the concavity. When a flat-bottomed display object is to be protected with such a long plunger, a longer switch throw results, i.e., a longer plunger travel distance is required before contact is made and an alarm can be signalled. Flat-bottomed display objects do not require long plunger lengths; however, the shorter plungers used for flat-bottomed objects cannot accommodate concave underside display objects because they are too short.

In the Pierson et al device, a pair of switches are provided in which one switch extends upwardly and one switch extends downwardly. Thus, if the displayed object and the display riser base are separately or both moved together sufficiently to release either of the trigger switches, a built-in buzzer or siren can be sounded to signal a possible unauthorized removal or theft event. The pin or plunger trigger switch elements of Pierson et al require that the displayed object be flat-bottomed or that extra-length plunger elements be used with display objects having concave undersides, as is frequently the case. Thus, a selection of differing plunger lengths must be made available to accommodate both flat and concave underside objects of different concave dimensions, or individual units must be tailored or otherwise specially adapted to those objects having a concave underside.

The switches of Pierson et al do not automatically compensate for display objects with underside surfaces which vary from flat to greatly concave. A fixed position switch contact must be contacted by a movable switch contact traveling with the triggering plunger to complete the alarm circuit. When a long plunger (such as is needed for a concave underside display object) is used with a flat or shallow concave underside display object, the distance of plunger travel and thus the switch throw length, is dependent on the distance the plunger extends away from the fixed contact. When a switch having a long plunger is used with a flat or shallow underside display object, the throw of the switch can be very long. Certain other problems and limitations arise from the Pierson et al design, notably that the alarm can frequently be defeated by merely stopping release of the plunger before the alarm switch contacts are closed. That is, the displayed object can be lifted partially to expose the plunger, which can then be restrained while the display object is removed from the display site. This is especially true when one of the longer plungers intended for a deeply concave underside object is used with a flat underside object instead of the intended concave underside object.

In the DeJong device, a first spring-loaded trigger pin or plunger extends inwardly in a first channel to restrain movement of a second spring-loaded trigger switch pin or plunger which extends into another channel disposed normal to the first plunger. When the fire extinguisher is lifted, the first plunger is released and thus extends upwardly under spring pressure. As the first plunger is expelled past the end of the second plunger, the second plunger is released and the electrical circuit is completed to sound an alarm indicating removal of the fire extinguisher, thus signalling a possible fire condition. While not necessarily intended as an anti-theft device, the DeJong device alarm contact closure can readily be bypassed by restraining either the exposed first plunger or the second plunger while the fire extinguisher is removed, as with the Pierson et al device.

The Brace et al plunger is magnetically levitated against the display object underside. As with the Pierson et al and DeJong switches, full travel of the plunger is required before contact closure is made to sound an alarm. This is especially true when a longer plunger intended for a concave object is used with a flat underside display object. The Brace device requires a relatively strong magnet to levitate the plunger. Strong magnets, of course, cannot be used near items sensitive to magnetic fields, such as magnetically encoded stock tags, credit cards, and the like. The magnets of the Brace et al trigger device, being hidden from view, are particularly hazardous to magnetically encoded stock tags and credit cards, especially to stock tags because of the likely proximity of the tag and the undershelf magnet. In the case of any magnetically sensitive device, however, the hidden nature of the Brace et al switch may cause demagnetization of the encoded data without warning or knowledge. Loss of the encoded information is particularly inconvenient because it cannot be detected.

The switches disclosed in the Pierson et al, DeJong, and Brace et al patents are subject to being easily disabled or bypassed without indicating an alarm condition. That is, the length of movement occurring before contact closure to signal an alarm can be significant. This permits one to raise the displayed object slightly, or slide it to the side, and then depress and restrain the trigger switch without signalling an alarm. A strong planar member may be used to facilitate depressing and restraining the plungers of each of these devices.

SUMMARY OF THE INVENTION

The present invention provides an alarm trigger switch mechanism which automatically accommodates both flat and concave display objects with a single, long length plunger, yet which requires only an extremely short length of plunger travel before contact closure. This eliminates the problem of easy circumvention as with the prior art. That is, the trigger switch mechanism of the present invention includes automatic maintenance of the throw length at a predetermined limit for a wide range of exposed plunger length exposures. The switch throw length remains constant at a predetermined limit; it is extremely short, essentially without regard to the length of the plunger exposed. The trigger switch tracks the plunger setting for any variable setting of the plunger. Trigger switches according to the present invention are simple, reliable, and non-magnetic. This is accomplished with a trigger switch mechanism having mutually movable contacts of a fixed and very short throw length mounted on lever arms related to the plunger position.

These switches may be provided in plug-in modular form, if desired. A plurality of trigger switches can be provided to form an alarm system, each trigger switch having its own display riser or base for support and switch concealment, so that many displayed objects may be protected with a single alarm circuit.

More particularly, the present alarm trigger switch mechanism is based on two lever arms, a first one of which has a forked end between the tines of which rests a contact extension extending from the other lever arm and which is associated with movement of a plunger. One end of the plunger extends through an opening in a support surface of the housing. The lever arm bearing the contact extension is spring-loaded to force the contact extension against a first fork end or tine which includes an electrical contact. The second fork tine is preferably not electrically conductive. Both tines preferably move together on the lever arm, thereby maintaining a consistent spacing between the forked ends. The switch contacts (and thus the throw length) track the plunger position for any position of the plunger. The spacing between the fork tines primarily determines the switch throw, from the open contact position (activated alarm trigger position) to the closed contact position (alarm signal triggered) position.

A force, usually the weight of the display object pressing against the plunger, depresses the plunger through the support surface opening by a variable distance into the decorative riser base or housing. Depressing the plunger into the housing causes separation of the contact extension and the first fork tine so as to open the circuit and electrically separate the switch contacts. The switch throw length is preferably defined as the distance the contact extension of the second lever arm must travel from its position touching the first fork tine contact to the second fork tine. Since the spacing is fixed, the switch throw length is therefore a predetermined limit. Release of the restraining weight (e.g., the displayed object mass) on the plunger releases the plunger to permit the contact extension to move into touching relationship with the first fork tine contact and thus close the circuit, sounding the alarm.

Of special significance is the distance which the plunger is permitted to travel before the alarm circuit is closed; that is, the switch contact throw length can be extremely short. The switch sensitivity can be set for as little as a fraction of a millimeter of plunger travel before the switch contacts touch and circuit closure occurs. The extremely short plunger travel distance precludes movement of the display object and restraint of the trigger switch in order to remove the displayed object without detection. Yet, the elongated plunger of the present invention readily accommodates and adjusts to both flat bottom display objects or objects having deeply recessed concave undersides. This is accomplished without changing the plunger length or any need for manual adjustment of the plunger or plunger length. The automatic adjustment is achieved because the trigger switch throw length is rendered essentially constant and independent of the distance the plunger is moved to set the alarm.

The alarm switch device of this invention permits use of a single elongated plunger the length of which can be substantially the entire depth of the decorative base, without increasing the switch throw required to signal an alarm condition. A single alarm device is effective for both flat and concave underside display objects.

In one variation of the invention, a "tilt" switch is incorporated to detect angular or sudden movement of the display. Several forms of such switches may be used, including a suspended mass within a sensor ring. A tilt switch holder may be formed in the molding process for the modular cartridge housing or the decorative base. Similarly, the channel in which the plunger travels may also be formed in the molding process.

The alarm device may also be positioned between a vertical surface and a display object, such as a wall-hung painting or the like, provided the display object produces sufficient force to depress the plunger and arm the trigger switch contacts. In such a vertical configuration, a tilt switch, if used, must be reoriented such that it is triggered only by movement from the desired orientation.

The alarm device is described herein in a normally closed configuration, wherein the trigger switch contacts are normally closed except when placement of the display object to be protected separates the switch contacts and arms the alarm circuit. In an alternate mode, the switch may be configured such that it is normally off and produces a continuous signal when the display object is present. In this configuration, a silent alarm can be signalled by movement of the display object, causing an interruption in the switched circuit. This configuration may be provided by reversal of the respective positions of the contact-bearing first fork tine end and the second fork tine end. A double-throw switch action may be provided by including separate switching contacts at both forked ends, each connected to a respective circuit. The present disclosure describes only two preferred embodiments of many possibilities for the apparatus claimed, i.e., for maintaining the switch throw length substantially constant and independent of the distance the triggering plunger is depressed when the distance is greater than the predetermined limit of the throw length.

In its modular form, an entire switch mechanism can simply be plugged into a decorative display base and activated without trouble or difficulty, providing enhanced alarm security with ease and reliability. More particularly, various elements of the alarm device, including one or more trigger switches, battery, tilt switch, the circuit board containing some or all of the alarm circuit, or the signalling annunciator may individually or collectively be formed into a single module which can be introduced into a decorative base, locked, and even powered on in a single movement.

The signalling function may be performed in a wide variety of ways, including audible, subaudible, or ultrasonic annunciators, visual or light alarms, including ultraviolet and invisible light spectrum signals, and radio frequency (RF) signalling. Encoding the signal output enables identification of one particular alarm device or group of alarm devices, as may be required to isolate an alarm condition to a particular area or display object. The signalling device may remain on for a period after the trigger incident occurs, and if audible, may use a warbling or frequency-varying effect, a light flashing effect, or other attention-raising alarm effect.

With the foregoing and other objects, advantages, and features of the invention that will become hereinafter apparent, the nature of the invention may be more clearly understood by reference to the following detailed description of the invention, the appended claims, and to the several views illustrated in the drawings.

BRIEF DESCRIPTION OF THE DRAWING FIGURES

DETAILED DESCRIPTION OF THE INVENTION

Figure 1:
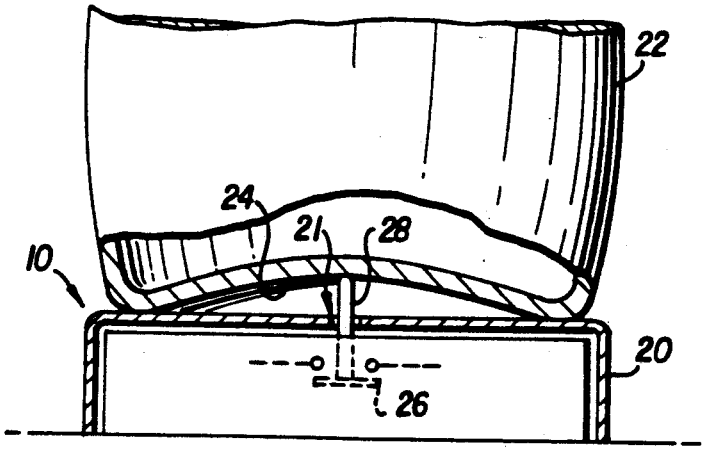
FIG. 1 PRIOR ART
FIG. 1 is an elevation view in partial section of a displayed object and a schematic view of a conventional trigger switch, and shows that the distance the plunger is depressed is a function of the degree of concavity in the bottom of the displayed object.

Referring now in detail to the drawings wherein like parts are designated by like reference numerals throughout, there is illustrated in FIG. 1 a display object alarm device which is designated generally by reference numeral 10. The alarm device includes a displayed object alarm mounting base riser or housing 20 for supporting the display object 22. The display object 22 shown is characterized by having a concave undersurface 24.

Housing 20 includes therein a switch 26, here illustrated in simplified schematic form. Switch 26 is normally closed and may be spring-loaded to ensure contact closure; an elongated triqger pin or plunger 28 extends from switch 26 through an opening 21 in the housing 20, to contact the undersurface 24 of display object 22. The switch 26 is opened by the weight of display object 22 pressing plunger 28 against the switch 26 to prevent contact closure.

Removal of the display object 22 releases plunger 28 and thus switch 26 is permitted to close, triggering an alarm (not shown). In the present invention, the alarm can be audible, visible, or both. Signalling may be accomplished in the absence of audible or visible alarm signals, such as by ultrasonic or RF signalling. A vibrating element in contact with one's skin or clothing may also be used to provide a silent alarm, if desired.

Turning now to FIGS. 2 through 5, a trigger switch assembly 12 according to the present invention is shown, located inside a housing 20. Plunger 28 extends outward through an opening in housing 20 to contact a display object (not shown). The present embodiment of the invention is described in terms of an elongated plunger forming the trigger of the switch; equivalent structures may be substituted. The plunger 28 includes a radially enlarged head 104 received in an elongated cylindrical chamber 102 having a slot in one side along at least a portion of the length of the cylinder 100.

A clevis 110 or the equivalent attached to housing 20 pinions a pivot axis 112 therein. First and second lever arms 114, 116 are pivotably restrained by the pivot axis 112 at their respective first ends, their opposing second ends being relatively free to move within limited arcs. The second end of first lever arm 114 is terminated in a fork end comprising top and bottom tines 118, 120. The tine spacing is preferably fixed, such that the tine spacing is retained regardless of the position of lever arm 116.

Figure 5:
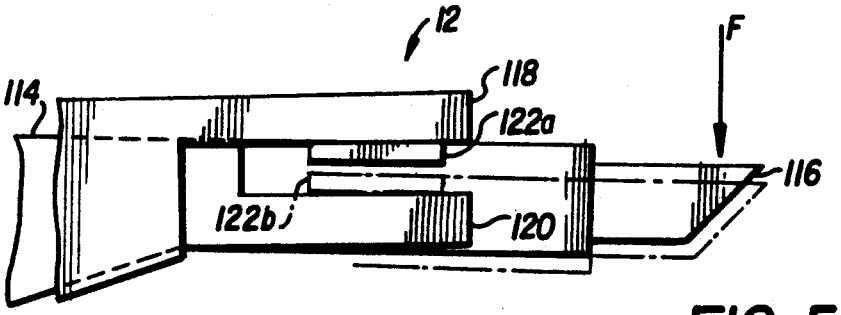
FIG. 5 is an enlarged fragmentary elevational view of the forked end of the first lever arm, and illustrates the switch contacts in open (phantom line) and closed (solid line) positions, and shows the fixed relationship of the first lever arm forked ends which limit switch throw.

In the embodiment presently disclosed, the bottom tine 120 is insulated or formed of an insulating material, while the top tine 118 is an electrical conductor forming a first electrical contact. That is, the top tine 118 may be an electrical conductor while first lever arm 114 itself is an insulator. Equivalent structures may be substituted, including lever arms of materials which are not insulators, provided the electrical contact surfaces are insulated where needed. As seen in FIG. 5, the top tine 118 can be a metal layer formed around the end of first lever arm 114. Second lever arm 116 includes along its length a short cantilevered extension 122 disposed between the tines 118, 120. The extension 122 is of an electrical conductor to form a second electrical contact; lever arm 116 itself can be an insulator. Other materials may also be substituted for lever arm 116, provided the electrical contacts are insulated from the lever arm where conductive materials are used for the lever arm.

Tines 118, 120 are closely spaced; the gap is made sufficiently larger than the thickness dimension of extension 122 such that extension 122 can freely move between the bottom and top tines 120, 118, respectively. The space between the tines 118, 120 less the thickness dimension of the extension 122 determines the amount of free movement (i.e., switch throw) of the restrained plunger 18 before contact closure is made to complete this portion of the alarm circuit. That is, the switch throw required to trigger the alarm can be very small; e.g., less than about 5 millimeters, and as little as a fraction of a millimeter. Thus, freedom of movement of the display object is greatly restricted before the alarm is set off.

A tension spring 108 or the equivalent extends from an anchor position 106 to a location 107 along the length of second lever arm 116, such that the force applied to the end of lever arm 116 provides substantially uniform tension on said lever arm. To prevent the respective lever arms 114, 116 from unwanted movement and to ensure that reliable, positive electrical contact is made upon switch closure, second lever arm 116 is preferably spring-loaded. While spring 108 serves primarily to close the contacts, it also urges the lever arms to push the plunger from the decorative base or riser housing. Varying the spring attachment location on the second lever arm 116 relative the fixed anchor position can change the tension force, and vice-versa. A variable tension force can be selected by selection of the anchor position 106 and the lever arm attachment location 107 with respect to the pivot axis 112.

In this preferred embodiment, closely adjacent first lever arm 114 and upper tine 118 lies a sliding contact surface 132 in frictional contact with upper tine 118, forming an electrical sliding brush contact and providing a slight physical resistance to movement of first lever arm 114. It is important that the sliding frictional resistance of the tine 118 contact surface and brush contact surface 132 limit unintended movement of the tines while permitting extension 122 to position lower tine 120 (and thus upper tine 118) upon placement of the display object mass on the plunger 28 of trigger switch 12. Electrical connections are established by wires 124, 126 (FIGS. 3, 4) connected to the sliding brush 132 and to sliding brush 134.

While the foregoing description of the sliding contact brushes 132, 134 illustrates a preferred embodiment, suitable equivalents capable of performing the two functions of making electrical contact with the fork tine 118 electrical contact surface and maintaining the position of the first lever arm 114 after placement of the display object are acceptable alternatives. Such alternatives may include separate mechanisms for accomplishing the two functions, e.g., a flexible wire for making contact and a friction element for maintaining the position of first lever arm 114 after placement of the display object. The relative positioning and shape of the sliding brush elements 132, 134 may be varied as desired to fit within the decorative base or housing 20.

Operation of the switch 12 is illustrated more clearly in FIG. 5, wherein the switch is represented in the normally closed contact position in solid line form and in the armed or separated contact position in broken line form. The switch 12 is armed by pressing the free end of second lever arm 116 downward with plunger 28 by a force F, as by the mass of a display object (not shown). As second lever arm 116 is pressed downward by force F, the extension 122 presses against tine 120 and moves the first lever arm 114 and thus the forked tines downward until the displayed object comes to a rest against a supporting surface of the decorative riser base or housing 20. At this point, force F no longer presses downward. That is, the extension 122 is moved to position **122*b* by second lever arm 116 and remains there due to the display object weight. When the force F is removed, extension 122 is driven upwards by the force of tension spring 108 (FIGS. 2, 3) until the extension contacts upper tine 118 at position 122*a*, closing the electrical circuit and signalling the alarm condition. This switch mechanism 12** thus provides for automatic adjustment of plunger positioning vis-a-vis the undersurface of the display object.

The foregoing assumes that the alarm device is to function in its normal, protecting mode without signalling an alarm condition until the occurrence of an alarm condition. However, the invention disclosed also comprehends a continuous signalling mode of operation in which an output signal is produced continuously until an alarm condition occurs, whereupon the signal output is interrupted. This latter operating mode is provided by the reversal of the electrically conductive fork tine and the non-conductive fork tine, such that the switch function is changed to a normally open configuration. That is, the upper tine 118 is configured as the non-conductive tine and lower tine 120 is configured as the conductive tine in the normally open mode.

Figure 6:
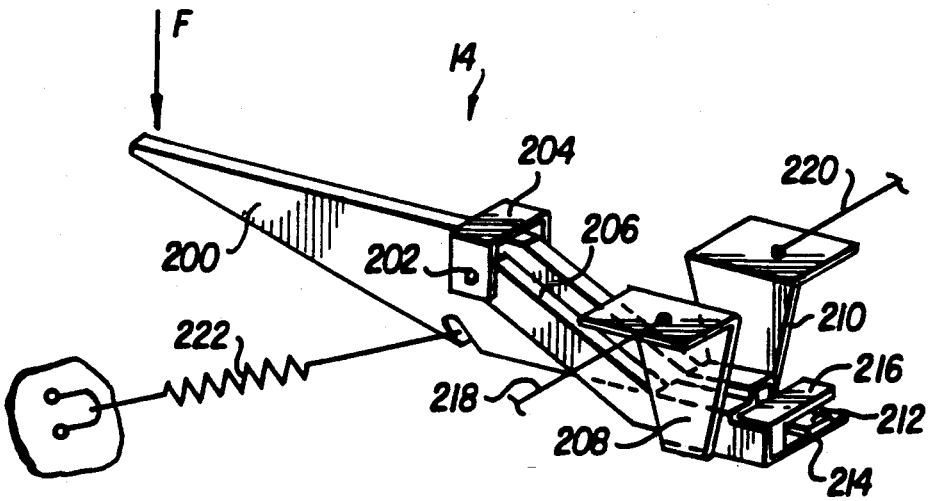
FIG. 6 is a perspective view of an alternative trigger switch embodiment.

An alternate embodiment of the trigger switch for an alarm device according to the present invention is shown in FIG. 6, where an elongated first lever arm 200 is centrally pivoted on pivot axis 202 within clevis 204 to rotate through an arc; a second lever arm 206 is also pivotably secured by clevis 204 to rotate on pivot axis 202 through an arc similar to that of first lever arm 200. A pair of sliding contact brushes 208, 210 adjacent the lever arms 200, 206 provides a slight frictional restraint against unwanted movement of lever arms 200, 206 and also maintains electrical contact as will be described hereinafter.

An electrically conductive extension 212 attached to the free end of first lever arm 200 extends past the end of the arm while in sliding frictional and electrical contact with sliding contact brush 210. A pair of spaced apart fork tines 214, 216 extends past the end of second lever arm 206; they also project slightly sideways over the extension 212, closely adjacent thereto. Upper fork tine 216 is of an insulating material or can be covered with an insulating material, while lower fork tine 214 is electrically conductive. Lower fork tine 214 is in sliding frictional and electrical contact with sliding contact brush 208. Electrical contact with the switch contacts formed by extension 212 and lower fork tine 214 is accomplished via wires 218, 220 connected to the sliding contact brushes.

As with the previous embodiment, the foregoing description of the sliding contact brushes 208, 210 is merely illustrative of a preferred embodiment: suitable equivalents capable of performing the two functions of maintaining electrical contact with the lever arms 200, 206 and also maintaining the position of the lever arms after placement of the displayed object are acceptable alternatives. Such alternatives include providing separate mechanisms for accomplishing the two functions, e.g., a flexible wire for making contact and a friction element for maintaining the position of the lever arms after placement of the displayed object. The relative positioning and shape of the sliding brush elements 208, 210 may be varied as desired to fit within the decorative base or housing 20.

As with the embodiment previously described, the fork tine 214, 216 spacing and the thickness dimension of the extension 212 determine the contact travel (i.e., the switch throw) before electrical contact is made to complete this portion of the alarm circuit. That is, the switch throw required to signal an alarm condition can be made very small, thus the fork tines 214, 216 are preferably placed quite close to one another. Note that the length of free plunger travel before contact closure is made is related to the distance from pivot axis 202 to the ends of first lever arm 200 where contact occurs. Again, the tine spacing is preferably fixed, such that the tine spacing is retained regardless of the position of lever arms 200, 206.

In operation, a pressure force F is applied to the first end of first lever arm 200, as by the mass of a display object, which lifts extension 212 upwards against the insulated fork tine 216, moving fork tine 216 upwards until the display object rests on the decorative base or housing 20. This operation is similar to that previously described in connection with FIGS. 2–5. When the display object rests on the base, force F no longer presses downward, whereupon upward travel of the fork tines stops. The sliding frictional contact resistance of sliding contact brush 208 holds second lever arm 206 and thus the fork tines 214, 216 in this position. Suitable equivalents, including those substitutes previously described, may be substituted for the brushes. They may also be relocated or made of other shapes which perform the equivalent function.

A tension spring 222 may be provided to supply a counterforce against the display object mass and tend to force the conductive extension 212 downwards towards conductive fork tine 214 when the display object mass is removed. Removal of the display object mass causes the switch to close and signal an alarm. This switch mechanism 14 thus provides for automatic adjustment of plunger positioning (i.e., the length of the plunger exposed above the housing) vis-a-vis the undersurface of the display object.

Again, the upper and lower contacts may be reversed to provide a normally open contact closure function, if desired.

Figure 7:
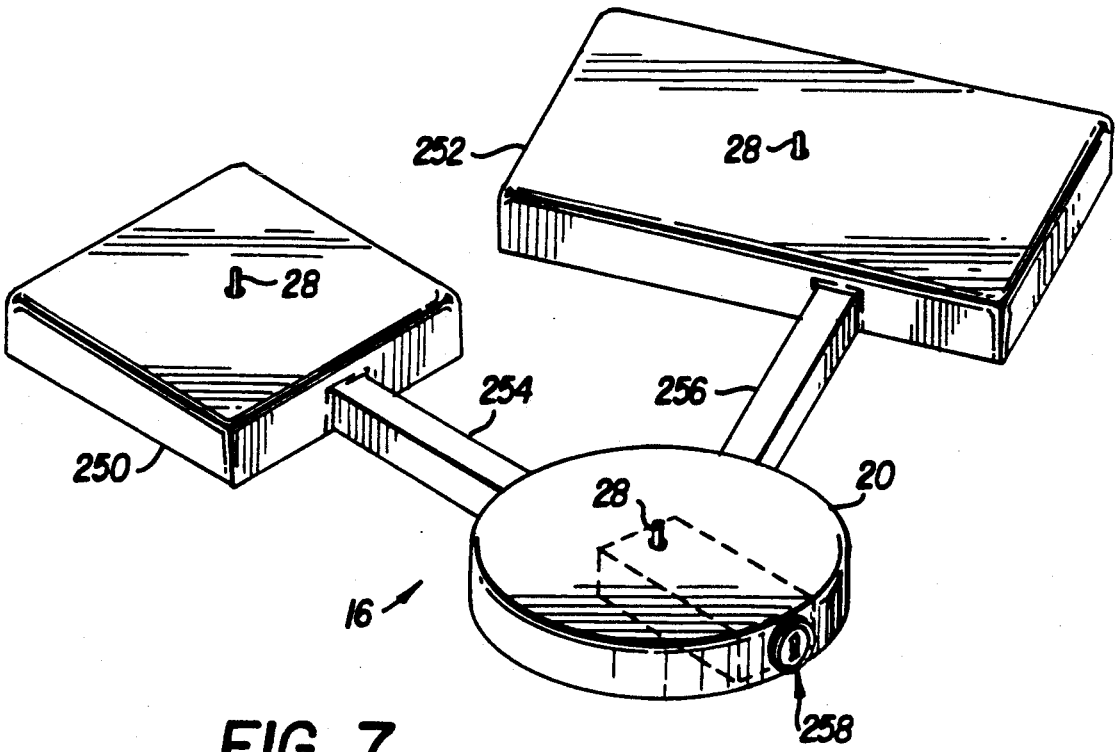
FIG. 7 is a perspective view of an alarm system for multiple display objects according to one embodiment of this invention.

A plurality of individual risers or housings 20, 250, 252, each having a trigger switch 12 and/or 14 and connected by a physical link 254, 256 may be combined to form an alarm system for a plurality of display objects as shown in FIG. 7. The elongated plungers 28 here represent the trigger switches which are not visible in this view. Links 254, 256 may be permanently attached or may simply plug into convenient electrical connectors on housings 20, 250, 252, as desired.

Also shown in FIG. 7 is an embodiment in which certain of the electrical components, such as the battery, switches, and annunciator, or the alarm generator and amplifier, are simply plugged into a housing 20 as a modular assembly 258. Shown in dotted line form in FIG. 7, the modular switch device may include a battery, power switch, one or more trigger switches, and a tilt switch. Plug-in elements 260, 262 (FIG. 8) or any combination of elements may be a part of the plug-in module. One modular variation feature of the invention includes a locking switch which both secures the module within the decorative base or housing 20 by locking same and serves to provide the on/off electrical switching function for the alarm device.

The decorative riser base or housing 20 may also be an outer enclosure adapted to slide over the base or housing 20, serving merely as a decoration.

Figure 8:
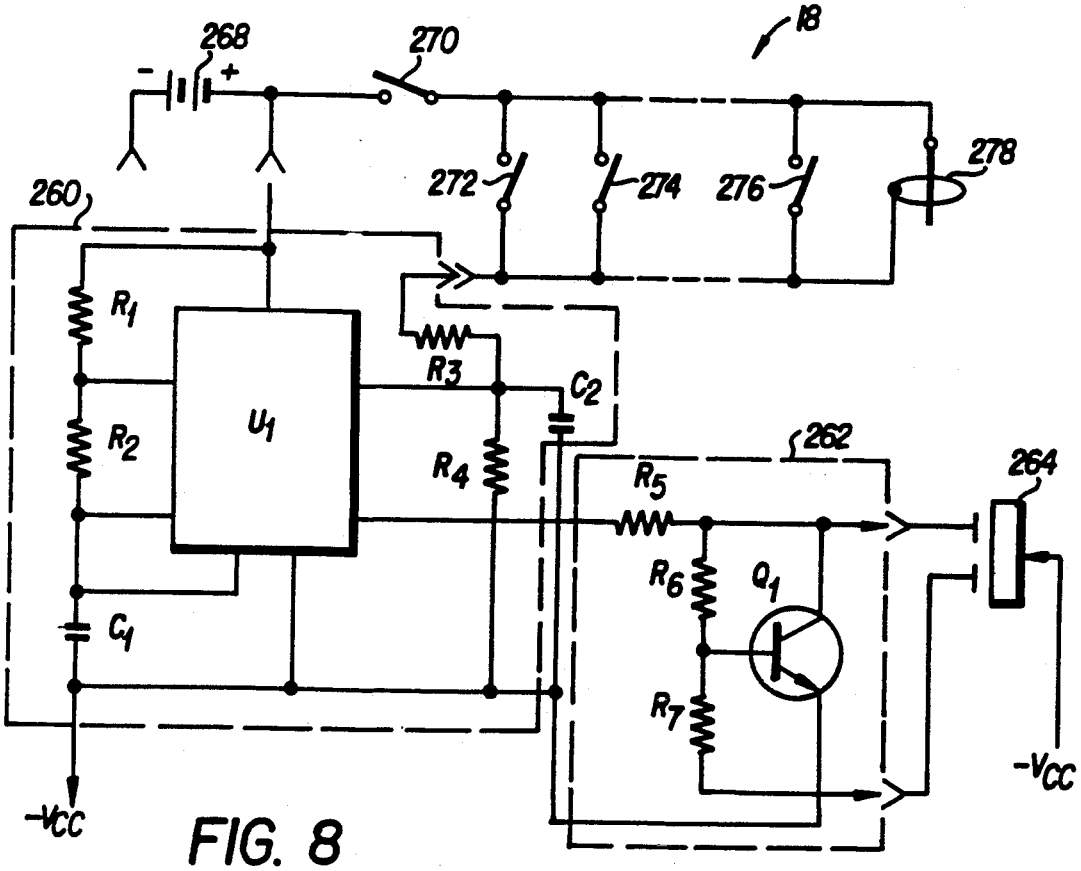
FIG. 8 is an exemplary schematic wiring diagram of an alarm circuit according to the present invention.
Figure 2:
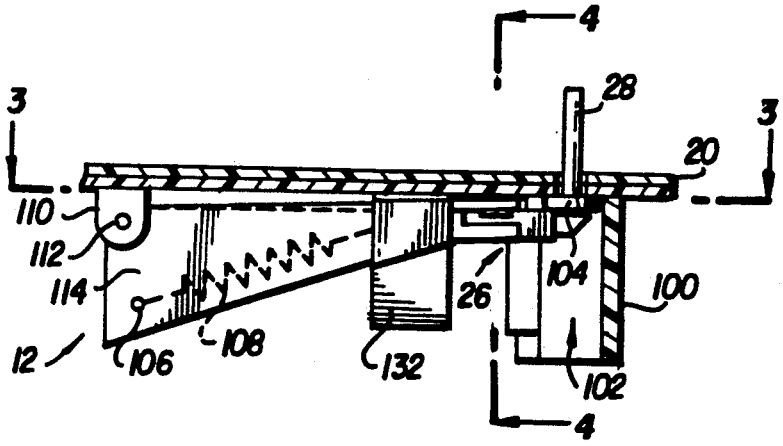
FIG. 2 is a side elevation view of a trigger switch, partially in section view, according to the present invention.
Figure 3:
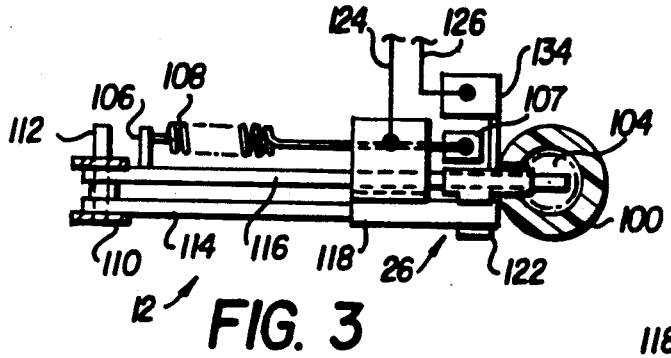
FIG. 3 is a partial sectional view of the trigger switch taken along line 3—3 of FIG. 2.
Figure 4:
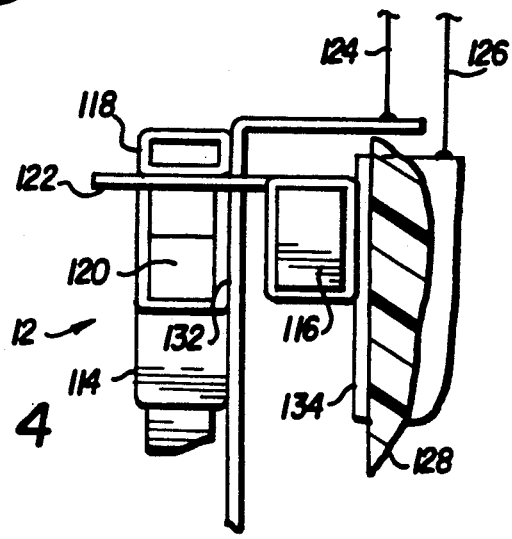
FIG. 4 is an enlarged fragmentary sectional view taken along line 4—4 of the switch of FIG. 2, showing the relation of the two lever arms.

Turning now to FIG. 8 there is illustrated in schematic diagram form an exemplary circuit for an alarm system 18 according to the present invention. U1 (which may be a type 555 integrated circuit timer) and associated resistors R1–R4 and capacitors C1, C2 form a conventional AC signal generator 260 or the equivalent. An additional timer circuit (not shown), of conventional design, may be used to terminate the signal after a predetermined time limit, or may be configured to modulate the AC signal. Transistor Q1 and resistors R5–R7 an amplifier 262 capable of driving an annunciator 264, which may be a piezoelectric audible alarm. An ultrasonic or RF output device may be substituted to provide a silent alarm function. Power is provided by one or more batteries 268. A main power switch 270, which may be a keyswitch, combination switch, an equivalent security switch, or other switch turns the system on and off. In support of the embodiment shown in FIG. 7, a plurality of trigger switches 272, 274, 276 such as switches 12 and/or 14 can be connected to the signal generator trigger line via resistor R3. Only a single trigger switch 272 is required for a simple alarm circuit; as many additional trigger switches as may be desired may be connected in parallel with switch 272. An additional tilt switch 278 may be included to provide an alarm when the riser or housing 20 is moved. A sensitive mercury switch may be used, or a conventional weight suspended in a contact sensitive ring may be used for this tilt switch. When such a tilt switch is used, it should be oriented according to the desired orientation of the alarm device, e.g., between a horizontal or vertical surface and a display object mounted thereon.

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. An alarm device for indicating unauthorized removal of various objects from a display riser, such objects including bottom surfaces having varying degrees of concavity formed therein, comprising:

a) a display riser including a housing having a support surface for supporting an object to be displayed;

b) switch means mounted in said housing and having a pair of electrical contacts for closing an electrical circuit when an object is lifted a predetermined distance from the support surface of said housing;

c) a plunger operatively coupled to said switch means and extending upwardly through an opening in the support surface of said housing, said plunger adapted to be depressed by the weight of an object placed thereon for a distance which varies according to the degree of concavity formed in the bottom of the object, and wherein depression of said plunger separates said electrical contacts to provide a throw length spacing having a predetermined limit, thereby setting the alarm; and d) means for maintaining said throw length substantially constant and independent of the distance said plunger is depressed when said distance is greater than the predetermined limit of said throw length.

2. The alarm device according to claim 1, said pair of electrical contacts including a first contact movable in direct relation to the distance said plunger is depressed and a second contact which is moved by and follows said first contact during setting of the alarm, and wherein said second contact remains substantially fixed in position in preparation for closure of said switch upon reverse action of the plunger.

3. The alarm device according to claim 2, said first and second contacts being carried by first and second lever arms respectively, said means for maintaining said throw length including means on said second lever arm spaced from said second contact for limiting said throw length, and wherein said first contact extends and is movable between said second contact and said limiting means.

4. The alarm device according to claim 3, wherein said means for limiting the throw length comprises first and second bifurcated ends of said second lever arm, said first electrical contact is attached at one of said bifurcated ends, and wherein said second electrical contact is attached to said first lever arm and positioned between said first and second bifurcated ends.

5. The alarm device according to claim 4, said first and second electrical contacts have thickness dimensions and wherein said first and second bifurcated ends less the thickness dimensions of the electrical contacts is less than 2 millimeters.

6. The alarm device according to claim 4, wherein said second contact is urged towards said first contact by a spring secured to the first lever arm and to the housing.

7. The alarm device according to claim 2, further including first sliding brush means for electrical connection to said first contact and second sliding brush means for electrical connection to said second contact wherein said first and second sliding brushes provide frictional contact with said lever arms to limit movement thereof.

8. The alarm device according to claim 1, further including an alarm circuit, wherein portions of the alarm circuit form a modular subassembly for installation in said housing.

9. The alarm device according to claim 1, further including a tilt switch in parallel with said switch means.

10. The alarm device according to claim 9, wherein said tilt switch includes a weight suspended in a contact sensitive ring.

11. The alarm device according to claim 1, wherein said pair of electrical contacts comprises first and second contacts and further including first sliding brush means for electrical connection to said first contact and second sliding brush means for electrical connection to said second contact.

12. The alarm device according to claim 1, wherein said throw length is less than about 5 millimeters.

13. The alarm device according to claim 1, wherein said throw length is less than about 1 millimeter.

14. The alarm device according to claim 1, said pair of electrical contacts including respective first and second contacts carried by respective first and second lever arms, further including means to urge said first and second contacts together under tension.

15. The alarm device according to claim 14, wherein said first lever arm and said urging means are coupled to expel said plunger from said housing.

16. The alarm device according to claim 1, wherein said alarm circuit produces a silent alarm.

17. The alarm device according to claim 1, wherein said alarm circuit produces visible and audible alarm signals.

* * * * *